US011424059B2

(12) United States Patent
Takahashi et al.

(10) Patent No.: US 11,424,059 B2
(45) Date of Patent: Aug. 23, 2022

(54) COMPOSITE MAGNETIC BODY

(71) Applicant: TDK Corporation, Tokyo (JP)

(72) Inventors: Kyohei Takahashi, Tokyo (JP); Isao Kanada, Tokyo (JP)

(73) Assignee: TDK Corporation, Tokyo (JP)

( * ) Notice: Subject to any disclaimer, the term of this patent is extended or adjusted under 35 U.S.C. 154(b) by 716 days.

(21) Appl. No.: 16/360,269

(22) Filed: Mar. 21, 2019

(65) Prior Publication Data

US 2019/0304648 A1 Oct. 3, 2019

(30) Foreign Application Priority Data

Mar. 28, 2018 (JP) ..... JP2018-062528

(51) Int. Cl.

| | |
|---|---|
| ***H01F 1/26*** | (2006.01) |
| ***H01F 1/33*** | (2006.01) |
| ***H01F 1/34*** | (2006.01) |
| ***H01F 1/147*** | (2006.01) |
| ***B22F 1/102*** | (2022.01) |
| ***B22F 3/11*** | (2006.01) |
| ***C22C 38/00*** | (2006.01) |

(52) U.S. Cl.

CPC ..... *H01F 1/26* (2013.01); *B22F 1/102* (2022.01); *B22F 3/11* (2013.01); *C22C 38/00* (2013.01); *H01F 1/147* (2013.01); *H01F 1/33* (2013.01); *H01F 1/34* (2013.01); *C22C 2202/02* (2013.01); *Y10T 428/32* (2015.01)

(58) Field of Classification Search

None

See application file for complete search history.

(56) References Cited

U.S. PATENT DOCUMENTS

| | | | | |
|---|---|---|---|---|
| 5,160,447 | A * | 11/1992 | Ishikawa | H01F 3/08 264/DIG. 54 |
| 9,418,780 | B2 * | 8/2016 | Oikawa | H01F 1/26 |
| 9,887,033 | B2 * | 2/2018 | Nakamura | H01F 27/255 |
| 11,056,257 | B2 * | 7/2021 | Yoshida | C08K 3/40 |
| 2002/0043303 | A1 * | 4/2002 | Takemoto | H01F 1/24 148/306 |
| 2003/0047245 | A1 * | 3/2003 | Takemoto | H01F 41/0246 148/306 |
| 2008/0226899 | A1 * | 9/2008 | Suetsuna | C22C 1/1094 428/329 |

(Continued)

FOREIGN PATENT DOCUMENTS

| | | | |
|---|---|---|---|
| CN | 104756203 | A | 7/2015 |
| JP | 2014-116332 | A | 6/2014 |
| JP | 2016-219643 | A | 12/2016 |

*Primary Examiner* — Kevin M Bernatz

(74) *Attorney, Agent, or Firm* — Faegre Drinker Biddle & Reath LLP

(57) ABSTRACT

The present invention provides a composite magnetic body comprising metal particles containing Fe or Fe and Co as a main component, a resin, and voids, wherein an average major axis diameter of the metal particles is 30 to 500 nm, an average aspect ratio of the metal particles is 1.5 to 10, and in a cross section of the composite magnetic body, a percent presence of the voids is 0.2 to 10 area % and an average equivalent circle diameter of the voids is 1 μm or less, and a saturation magnetization of the composite magnetic body is 300 to 600 emu/cm$^3$.

2 Claims, 1 Drawing Sheet

(56) References Cited

U.S. PATENT DOCUMENTS

| | | | | |
|---|---|---|---|---|
| 2012/0038532 | A1* | 2/2012 | Yonetsu | H01Q 17/00 343/787 |
| 2012/0274429 | A1* | 11/2012 | Ogawa | H01F 1/26 335/299 |
| 2014/0158929 | A1 | 6/2014 | Oikawa et al. | |
| 2015/0287507 | A1* | 10/2015 | Nishio | B22F 3/12 335/297 |
| 2020/0303106 | A1* | 9/2020 | Su | H02K 1/02 |

* cited by examiner

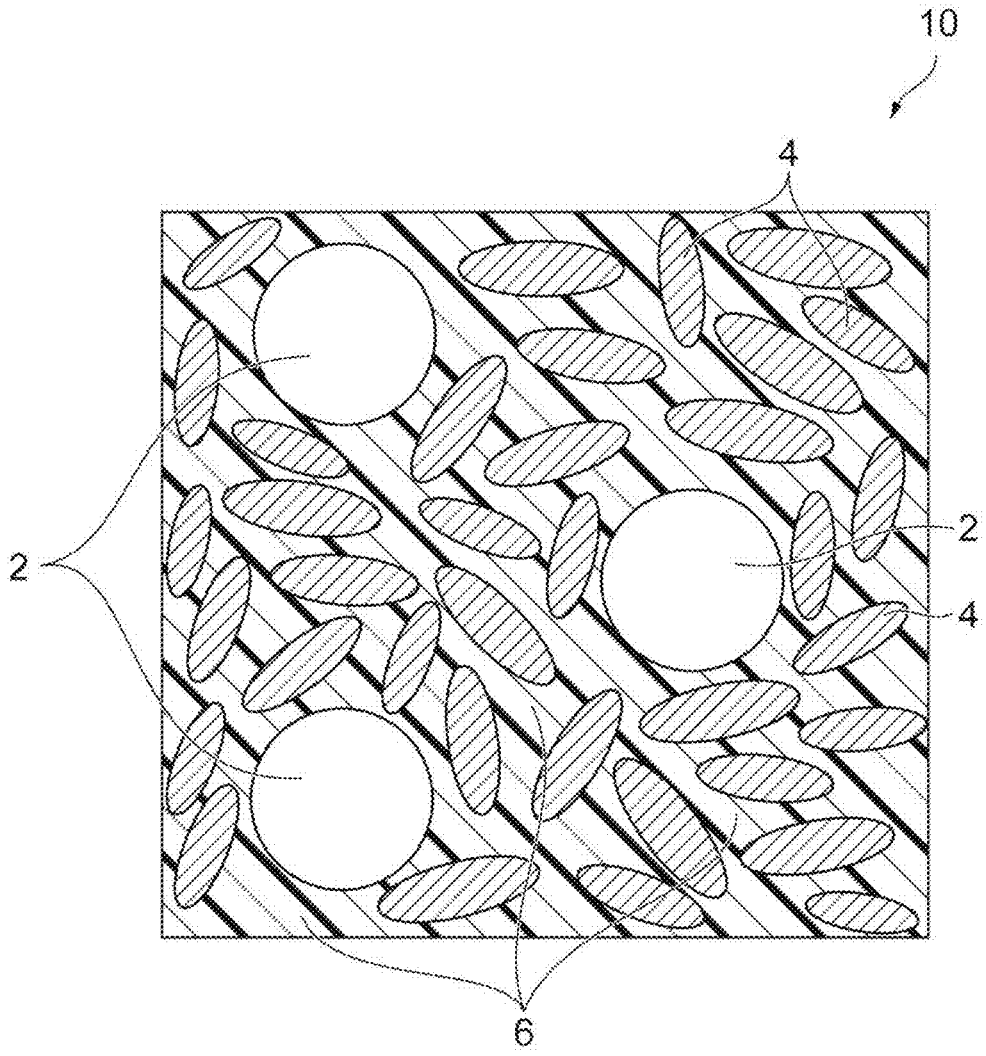
10
4
2
2
4
6

COMPOSITE MAGNETIC BODY

TECHNICAL FIELD

The present invention relates to a composite magnetic body.

BACKGROUND

In recent years, frequency bands used in wireless communication devices such as cellular phones and portable information terminals have been increased in frequency, and radio signal frequencies used are in the GHz band such as the 2.4 GHz band used in wireless LAN or the like. In order to improve characteristics of electronic components and miniaturize the dimensions thereof used in such GHz band (high frequency band), such as inductors, EMI filters, and antennas, magnetic materials have been required to have high magnetic permeability and low magnetic loss. The EMI filter is used for high frequency noise countermeasure of electronic equipment, and the antenna is used for wireless communication equipment.

Particularly when a magnetic material is used for the above described electronic component which is required to be miniaturized, it is preferable that the magnetic material is applicable to processes such as screen printing, injection molding, and extrusion which can cope with compact and complicated shapes. In this case, a composite magnetic material prepared by mixing a magnetic powder and a resin is more suitable than a sintered body for a form of the magnetic material.

As a composite magnetic material having high magnetic permeability and low magnetic loss in a high frequency band, Patent Literature 1 has proposed a magnetic composite material wherein magnetic metal particles having an aspect ratio (major axis length/minor axis length) of needle shape of 1.5 to 20 are dispersed in a dielectric material. Patent Literature 2 has proposed a composite magnetic body prepared with a hexagonal ferrite powder having an average particle diameter of 1 to 150 μm, a metal powder having an average particle diameter of 0.01 to 1 μm and containing Fe as a main component, and a resin.

CITATION LIST

Patent Literature

Patent Literature 1: Japanese Unexamined Patent Publication No. 2014-116332

Patent Literature 2: Japanese Unexamined Patent Publication No. 2016-219643

SUMMARY

However, with respect to the magnetic composite material using the magnetic metal particles disclosed in Patent Literature 1, the loss tangent tan $\delta_\mu$ is as small as 0.014 at a frequency of 3 GHz when the magnetic permeability μ' as small as 1.37, and on the other hand, tan $\delta_\mu$ is as large as 0.096 when μ' is as large as 1.98. In the composite magnetic body using the hexagonal ferrite powder and the metal powder disclosed in Patent Literature 2, since tan $\delta_\mu$ is 0.02 when μ' is 1.80 at a frequency of 2.4 GHz, tan $\delta_\mu$ is expected to be even greater at more than 2.4 GHz frequencies. In addition, in Patent Literature 2, magnetic characteristics at frequencies other than 2.4 GHz are not disclosed. According to the investigations of the inventors of the present invention, the conventional technology cannot satisfy both of the high magnetic permeability and the low magnetic loss at the same time in the high frequency band.

The present invention has been made in view of the above circumstances, and the object thereof is to provide a composite magnetic body having high magnetic permeability and low magnetic loss in a high frequency band, and a high frequency electronic component using the same.

The present invention provides a composite magnetic body comprising metal particles containing Fe or Fe and Co as a main component, a resin, and voids, wherein an average major axis diameter of the metal particles is 30 to 500 nm, an average aspect ratio of the metal particles is 1.5 to 10, in a cross section of the composite magnetic body, a percent presence of the voids is 0.2 to 10 area % and an average equivalent circle diameter of the voids is 1 μm or less, and a saturation magnetization of the composite magnetic body is 300 to 600 emu/cm$^3$. According to the composite magnetic material, high magnetic permeability and low magnetic loss can be obtained in a high frequency band.

The present invention also provides a high frequency electronic component comprising the composite magnetic body. The above described high frequency electronic component can cope with a wide range of high frequency band.

The present invention can provide a composite magnetic body having high magnetic permeability and low magnetic loss in a high frequency band, and a high frequency electronic component using the same.

BRIEF DESCRIPTION OF THE DRAWING

FIG. 1 is a schematic cross-sectional view of a composite magnetic body according to one embodiment of the present invention.

DETAILED DESCRIPTION

Hereinafter, preferred embodiments of the present invention will be described. However, the present invention is not limited to the following embodiments.

[Composite Magnetic Body]

FIG. 1 is a schematic sectional view of a composite magnetic body according to one embodiment of the present invention. The composite magnetic body 10 according to the present embodiment is a molded body including the metal particles 4, the resin 6, and the voids 2. The composite magnetic body 10 has saturation magnetization of 300 to 600 emu/cm$^3$. The saturation magnetization of the composite magnetic body 10 is 300 emu/cm$^3$ or more, allowing to improve the magnetic permeability in the high frequency band. Further, the saturation magnetization of the composite magnetic body 10 is 600 emu/cm$^3$ or less, allowing to suppress an increase in magnetic loss in a high frequency band. From the same viewpoint, the saturation magnetization is preferably 350 to 550 emu/cm$^3$, and more preferably 400 to 500 emu/cm$^3$.

(Void)

In the present embodiment, the metal particle 4 or the resin 6 does not exist in the void 2 in the composite magnetic body 10, and for example, air in the environment or a solvent volatilized during the manufacturing process of the composite magnetic body 10 or the like, exists.

In the cross section of the composite magnetic body 10 according to the present embodiment, the percent presence of the voids 2 is 0.2 to 10 area %. The composite magnetic body 10 containing the voids 2 at a percent presence of 0.2 area % or more allows to relieve stress on the metal particles 4 due to curing shrinkage of the resin or the like, suppressing a decrease in resonance frequency due to magnetostriction, and suppressing an increase in magnetic loss in the relatively high 3 GHz band particularly among high frequency bands. On the other hand, the percent presence of the voids 2 is 10 area % or less, allowing to suppress the denseness of the metal particles 4, to reduce the interaction between the densely arranged metal particles 4, to suppress the reduction of the resonance frequency, and to reduce the magnetic loss in the relatively high 3 GHz band in particularly among high frequency bands. The percent presence of the voids 2 is 10 area % or less, also allowing to suppress excessive decrease in saturation magnetization of the composite magnetic body 10. From the same viewpoint, it is preferable that the percent presence of the voids 2 is 0.2 to 5.0 area %.

In the present embodiment, the average equivalent circle diameter of the voids 2 is 1 μm or less. The circle equivalent diameter of the voids 2 is 1 μm or less, allowing to reduce the variation of the interaction between the metal particles 4 and narrowing the width of the resonance, and the magnetic loss can be thus reduced. From the same viewpoint, the average equivalent circle diameter of the voids 2 is preferably 0.8 μm or less, more preferably 0.6 μm or less, and furthermore preferably 0.5 μm or less. The average equivalent circle diameter of the voids 2 can be, for example, 0.1 μm or more.

In the composite magnetic body 10 according to the present embodiment, the percent presence of the voids 2 is 0.2 to 10 area %, and the average circle equivalent diameter is 1 μm or less. Therefore, the voids 2 of a certain amount or more is finely distributed within the composite magnetic body 10 and easily exists among the metal particles 4, and the effect of reducing the magnetic loss is easily obtained.

(Metal Particle)

The metal particle 4 contains Fe, or Fe and Co as a main component, and preferably contains Fe and Co as a main component. The metal particle 4 contains Fe or Fe and Co having high saturation magnetization as a main component, allowing for the composite magnetic body to have high magnetic permeability. The main component means a component occupying 50 mass % or more. The metal particle 4 preferably further contains at least one nonmagnetic metal element selected from the group consisting of Al, R, Mn, Ti, Zr, Hf, Mg, Ca, Sr, Ba, and Si, and more preferably contains Al or R, and furthermore preferably contains Al and R. R represents a rare earth element or Y, and preferably represents Y. Examples of rare earth elements include La, Ce, Pr, Nd, Sm, Eu, Gd, Tb, Dy, Ho, Er, Tm, Yb, Lu, and Y. In addition to Al and/or R, the metal particle 4 may further contain at least one selected from the group consisting of Mn, Ti, Zr, Hf, Mg, Ca, Sr, Ba, and Si as the above described nonmagnetic metal elements. The metal particle 4 can also be referred to as the metal magnetic particle.

The total mass ratio of Fe and Co in the metal particle 4 (mass ratio of Fe when the metal particle 4 does not contain Co) is preferably 80 mass % or more, more preferably 85 mass % or more, and furthermore preferably 90 mass % or more. The mass ratio of Fe and Co is 80 mass % or more, easily providing high magnetic permeability. The mass ratio of Fe and Co in the metal particle 4 may be 99 mass % or less, and may be 95 mass % or less. The mass ratio of Fe and Co is 99 mass % or less, easily providing low magnetic loss. When the metal particle 4 contains Co, it is preferable that the mass ratio of Co in the metal particle 4 is 1.0 to 30 mass %. The mass ratio of Co is 1 mass % or more, not easily oxidizing the metal particle and easily providing stable magnetic characteristics. The mass ratio of Co is 30 mass % or less, allowing to suppress a decrease in magnetic permeability of the metal particle 4. From the same viewpoint, the mass ratio of Co is more preferably 3.0 to 25 mass %, and furthermore preferably 5.0 to 20 mass %. In the present specification, the mass ratio is the mass ratio based on the total mass of elements having an atomic number of 11 (Na) or more. Therefore, for example, oxygen contained in a metal oxide film, which will be described later, is not considered in the measurement and calculation of the mass ratio.

It is preferable that the mass ratio of Al in the metal particle 4 is 0.1 to 5.0 mass %. It is preferable that the mass ratio of R in the metal particle 4 is 0.5 to 10.0 mass %. The mass ratio of Al and/or R is the above lower limit value or more, further strengthening the metal oxide film of the metal particle, allowing to further reduce the magnetic loss, and also improving the reliability of the magnetic characteristics. The mass ratio of Al and/or R is the above upper limit value or less, allowing to suppress a decrease in saturation magnetization and to suppress an accompanying increase in magnetic loss. From the same viewpoint, it is more preferable that the mass ratio of Al is 1.0 to 3.0 mass %. Further, it is more preferable that the mass ratio of R 2.0 to 6.0 mass %.

The mass ratio of at least one nonmagnetic metal element selected from the group consisting of Mn, Ti, Zr, Hf, Mg, Ca, Sr, Ba, and Si in the metal particle 4 can be 0.1 to 1.0 mass %.

In the present embodiment, the metal particles 4 has an average aspect ratio of 1.5 to 10. The average aspect ratio is the average value of the ratios (aspect ratio) of the major axis diameter to the minor axis diameter of the particles. The average aspect ratio of the metal particles is within the above range, allowing to control the natural resonance frequency and to reduce the magnetic loss. That is, the average aspect ratio is 1.5 or more, allowing to increase the difference between the use frequency and the resonance frequency and thereby to reduce the magnetic loss of the composite magnetic body. In addition, the average aspect ratio is 10 or less, allowing to suppress an increase in magnetic loss even in the GHz band while suppressing a decrease in magnetic permeability of the composite magnetic body, and to provide a composite magnetic body applicable to a high frequency band. From the same viewpoint, the average aspect ratio of the metal particles 4 is preferably 3 to 10, and more preferably 5 to 10. It is preferable that the shape of the metal particle 4 is needle shape.

In the present embodiment, the average major axis diameter of the metal particles 4 is 30 to 500 nm. The average major axis diameter of the metal particles is 30 nm or more, allowing to improve the filling property of the metal particles in the composite magnetic material and to provide high magnetic permeability. The average major axis diameter of the metal particles 4 is 500 nm or less, not only allowing to provide the single magnetic domain state and to eliminate the loss of domain wall resonance, but also to suppress eddy current loss. From the same viewpoint, the average major axis diameter is preferably 40 to 350 nm, and more preferably 45 to 120 nm. The average minor axis diameter of the metal particles 4 is, for example, about 5 to 50 nm, and can be 7 to 30 nm.

The metal particle 4 can include a metal core portion and a metal oxide film coating the metal core portion. The metal core portion has conductivity, but the metal oxide film has insulating property. The metal particle 4 has the metal oxide film, allowing to provide the insulating property between the metal particles 4 and to reduce the magnetic loss caused by the generation of the eddy current between the particles.

In the metal particle 4, the metal core portion contains the above described element contained in the metal particle 4 as a metal (zero valence), and has a magnetic portion containing Fe or Fe and Co as a main component. Since the metal core portion is coated with the metal oxide film, the metal core portion can exist without being oxidized even in the atmosphere. It is preferable that the above described magnetic portion is a Fe—Co alloy. Formation of a Fe—Co alloy in which Co is solid-soluted in Fe improves the saturation magnetization, and high magnetic permeability is easily obtained.

In the metal particle 4, the metal oxide film contains the above-described element included in the metal particle 4 as an oxide. In the present embodiment, it is preferable that elements other than Fe and Co are contained in the metal oxide film. The elements other than Fe and Co are included in the metal oxide film, allowing to further improve the insulation property between the metal particles 4 without lowering the magnetic property and to further reduce the magnetic loss caused by the generation of the eddy current.

The thickness of the metal oxide film can be, for example, 1 to 20 nm. The thickness of the metal oxide film is 1 nm or more, easily providing the insulating property between the metal particles and the effect of reducing the magnetic loss. The thickness of the metal oxide film is 20 nm or less, easily suppressing reduction of the magnetic property. From the same viewpoint, the thickness of the metal oxide film may be 1.5 to 15 nm, or may be 2.0 to 10 nm.

In the present embodiment, the volume ratio of the metal particles 4 in the composite magnetic body 10 is, for example, 30 to 60 volume %. The volume ratio of the metal particles 4 is 30 volume % or more, easily providing desired magnetic characteristics. The volume ratio of the metal particles 4 is 60 volume % or less, facilitating handling in processing. From the same viewpoint, it is preferable that the volume ratio is 40 to 60 volume %. Therefore, in the present specification, the volume ratio in the composite magnetic body 10 is the ratio to the volume of the composite magnetic material excluding the voids.

(Resin)

The resin is a resin (insulating resin) having electrical insulating property and is a material which is between the metal particles 4 in the composite magnetic body, binds the metal particles, and further can improve the insulating property between the metal particles 4. Examples of the insulating resin include a silicone resin, a phenol resin, an acrylic resin, an epoxy resin, and a cured product thereof. One of these resins may be used alone, or two or more of these resins may be used in combination.

The volume ratio of the resin in the composite magnetic body can be, for example, 25 to 65 volume %. The volume ratio of the resin is 25 volume % or more, easily providing the insulating property and the bonding strength between the metal particles 4. The volume ratio of the resin is 65 volume % or less, easily exerting the property of the metal particle in the composite magnetic material.

[Method for Producing Composite Magnetic Body]

The method for producing the composite magnetic body according to the present embodiment includes a step of producing the metal particles, a step of mixing the metal particles and the resin to obtain a slurry-like composite magnetic material, a step of drying the composite magnetic material, a step of molding the dried body, and a step of curing the molded body. A step of preparing the composite magnetic material includes a step of mixing the metal particles, the resin, and the solvent. The above described step of producing the metal particle includes a neutralization step, an oxidation step, a dehydration-annealing step, a heat treatment step, and a gradual oxidation step. The above described method for producing the metal particles may further include a coating step after the oxidation step and before the dehydration-annealing step. As an example, the method for producing the metal particles containing Fe and Co as a main component will be described in order.

(Neutralization Step)

In the neutralization step, the particle containing ferrous hydroxide ($Fe(OH)_2$) is obtained by neutralization. The particle further contains Co in the form of substituting a part of Fe of ferrous hydroxide, or in the form of hydroxide of Co independent on ferrous hydroxide. Raw materials of Fe and Co are prepared. An example of the raw material of Fe includes iron sulfate. An example of a raw material of Co includes cobalt sulfate. In the neutralization step, the above raw material is dissolved in water to prepare an acidic aqueous solution, and this solution is mixed with an alkali aqueous solution. The particle containing ferrous hydroxide is obtained by neutralizing the (acidic) aqueous solution of the raw material with an alkali aqueous solution to make the aqueous solution weakly acidic. The conditions of the neutralization step and the oxidation step described later are variously changed, allowing to control the growth of the particle in the oxidation step and the size and shape of the goethite particle to be obtained, and furthermore, the size and shape of the obtained metal particle. For example, the size of the goethite particle can be controlled by adjusting the metal ion concentration in the aqueous solution of the raw material. The aspect ratio of goethite particle can be controlled by adjusting the neutralization ratio with the alkali aqueous solution (for example, the aspect ratio can be increased by increasing the neutralization ratio). Controlling the size and shape of the goethite particle allows to easily control the size and shape of the metal particle.

(Oxidation Step)

In the oxidation step, the particle containing ferrous hydroxide after the neutralization step is oxidized. That is, bubbling is carried out in the aqueous solution after the neutralization step to provide the aqueous solution with oxygen. The particle containing ferrous hydroxide is oxidized and the particle grows during the oxidation reaction, allowing to provide the goethite ($\alpha$-FeO(OH)) particle containing Co. The compound having the element such as Al, R, Ti, Zr, and Hf can be added to the above described aqueous solution to be subjected to bubbling. R represents a rare earth element or Y. As a result, these elements are incorporated into the particle during the growth of the particle, and the goethite particle containing the above described element in addition to Co is obtained. The compound added to the aqueous solution may be, for example, a sulfate of the above described element. The obtained goethite particle is filtered, washed with ion exchanged water, and isolated by drying.

(Coating Step)

In the coating step, the nonmagnetic metal element is coated on the surface of the goethite particle containing Co obtained after the oxidation step. In the coating step, the goethite particle after the oxidation step is charged into an alcoholic solution of the alkoxide of nonmagnetic metal elements such as Mn, Al, R, Ti, Zr, Hf, Mg, Ca, Sr, Ba, and Si. R represents a rare earth element or Y. Stirring while gradually hydrolyzing the alkoxide allows to coat the above described nonmagnetic metal element on the surface of the goethite particle. In the coating step, a single element may be coated or a plurality of elements may be coated. In the case of coating a plurality of elements, a plurality of elements may be separately coated by repeating two or more steps, or a plurality of elements are simultaneously coated in one step. The goethite particle after coating is filtered, washed with an alcohol or the like, and isolated by drying. In the coating process, it is preferable that Al or R is coated. The thickness of the coating is controlled by the alkoxide concentration in the above described alcohol solution and is appropriately set to obtain a desired thickness of the oxidized metal film. The coating causes the goethite particle to contain the above described nonmagnetic metal element on its surface. In the coating step, the coating element is mainly contained in the metal oxide film of the metal particle.

(Dehydration-Annealing Step)

In the dehydration-annealing step, the goethite particle containing Co obtained as described above is heated under an oxidizing atmosphere. The heating causes the goethite particle to be dehydrated and oxidized to become a Co-containing hematite ($\alpha$-$Fe_2O_3$) particle. The heating temperature is, for example, 300 to 600° C. When the goethite particle contains the nonmagnetic metal element, the hematite particle containing Co and the nonmagnetic metal element can be obtained.

(Heat Treatment Step)

In the heat treatment step, the hematite particle containing Co obtained in the dehydration-annealing step is heated in a reducing atmosphere such as a hydrogen atmosphere. The heating temperature is, for example, 300 to 600° C. When the hematite particle contains the nonmagnetic metal element such as Mn other than Fe and Co, the hematite particle may be heated under an oxidation-reduction atmosphere. The oxidation-reduction atmosphere means an atmosphere in which both an oxidation reaction and a reduction reaction can occur in the hematite particle containing Co, which is the object of heat treatment. The oxidation-reduction atmosphere can be obtained by, for example, sending an oxidation-reduction gas into a furnace for heat treatment. Examples of the oxidation-reduction gas includes a mixed gas of carbon monoxide and carbon dioxide and a mixed gas of hydrogen and steam. When the hematite particle is heated under an oxidation-reduction atmosphere, Fe and Co are not oxidized, the above described nonmagnetic metal can be oxidized and concentrated on the surface of the metal particle, and the metal oxide film is easily formed. For this reason, it is easy to obtain the metal particle having high magnetic property and excellent insulating property, and eddy current loss is easily reduced.

After the heat treatment, the inside of the furnace is switched from the (oxidation) reduction gas to the inert gas, and is cooled to around 200° C.

(Gradual Oxidation Step)

In the gradual oxidation step, the oxygen partial pressure inside the furnace cooled to around 200° C. after the heat treatment step is gradually increased and gradually cooled to room temperature. As a result, the surface of the particle is gradually oxidized, and a metal oxide film containing an element existing on the particle surface before the heat treatment step and an element concentrated on the surface in the heat treatment step is formed. Examples of the element present on the particle surface before the heat treatment step include Fe, Co and other elements added in the neutralization step or the oxidation step and present on the surface of the goethite particle after the oxidation step, and the nonmagnetic metal element coated on the surface of the particle in the coating step or the like.

As described above, the metal particles 4 including the metal core portion and the metal oxide film coated on the metal core portion are obtained.

A slurry-like composite magnetic material is then prepared using the obtained metal particles 4.

(Mixing Step)

In the mixing step, the metal particles 4 obtained as described above and, for example, a thermosetting resin, a curing agent, and an organic solvent are mixed to obtain a composite magnetic material. In this step, other components such as a dispersant and a coupling agent may be added. As a mixing method, for example, a stirrer/mixer such as a pressure kneader and a ball mill is selected. Mixing condition is not particularly limited, but is, for example, at room temperature for 20 to 60 minutes so that the metal particles 4 can be dispersed in the resin. The metal particles 4, the thermosetting resin, and the curing agent are mixed with the organic solvent, enhancing the dispersibility of the metal particles and easily forming the voids in the composite magnetic body by the solvent volatilized in the subsequent drying step. The organic solvent may be a solvent which has a boiling point and a saturated vapor pressure so that desired voids is formed in the drying step described later and has a boiling point below the curing temperature of the resin. An example of such an organic solvent includes acetone. It is preferable that the thermosetting resin is in a solid state at room temperature (25° C.). This easily suppresses association of bubbles formed after removal of the solvent in the subsequent drying step and dissipation to the outside of the system. As described above, the slurry-like composite magnetic material containing the metal particles, the thermosetting resin, the curing agent, and the organic solvent is obtained. Instead of the thermosetting resin and the curing agent, a thermoplastic resin may also be used.

(Drying Step)

In the drying step, a slurry-like composite magnetic material is applied and dried to obtain a dried body. Drying can form the voids in the dried body using the volatilized organic solvent. The drying temperature may be lower than the curing temperature of the resin, and it is preferable that the drying temperature is 25 to 80° C. for example. It is preferable that the drying time is 0.5 to 1.5 hours. The drying condition is set within the above range, allowing to contain a desired amount of the voids having a desired size in the dried body. The coating film after drying is overlapped, allowing to provide the dried body having a desired shape.

(Molding Step)

In the molding step, a molded body is obtained by heating, pressurizing, and molding the dried body. When the voids are formed in the drying step, the sizes of the voids in the dried body is large, and the amount of the voids is often large or small. The dried body is subjected to the molding step, allowing to further adjust the sizes and amount of the voids formed in the drying step. In the molding step, the molding temperature is, for example, 60 to 80° C. Increasing the molding temperature easily and properly controls the size and amount of the voids due to melting of the resin. The molding temperature is lowered, allowing to suppress the progress of the curing reaction during the molding step, to suppress the excessively low viscosity of the resin in the dried body, and to suppress the disappearance of the voids in the dried body. In the molding step, the dried body may be held in a heated and pressurized condition. The molding-holding time may be, for example, 0 to 1 minutes. Setting the molding-holding time can control the sizes of the voids to be smaller. Shortening the molding-holding time tends to be able to suppress the disappearance of the voids present in the dried body. The molding pressure is, for example, 100 to 200 MPa. Increasing the molding pressure can control the percent presence of the voids to be smaller. Decreasing the molding pressure tends to keep the percent presence of the voids large.

(Curing Step)

In the curing step, the molded body is heated to cure the resin. The heating temperature is appropriately selected depending on the type of the resin and the curing agent, and the heating temperature is higher than the molding temperature in the molding step and can be 120 to 200° C. The heating time can be 0.5 to 3 hours.

Note that, temporary curing may be performed before the above described curing. In the case of the temporary curing, the above described curing after the temporary curing may be referred to as main curing. The heating temperature for the temporary curing can be 60 to 120° C. The heating time can be 0.5 to 2 hours. The temporary curing can suppress extremely low viscosity of the resin at the main curing.

The temporary curing and the main curing may be carried out either in an air atmosphere, in an inert gas atmosphere, or in a vacuum, and in the inert gas atmosphere or in the vacuum is preferable in order to suppress oxidation of the metal particle.

As described above, the composite magnetic body including the metal particles, the resin, and the voids is obtained. The composite magnetic body according to the present embodiment has high magnetic permeability and low magnetic loss in the high frequency band. Therefore, the composite magnetic body according to the present embodiment is useful for a constituent material of high frequency electronic components.

EXAMPLES

Hereinafter, the present invention will be described in more detail with reference to Examples, but the present invention is not limited to the following Examples.

[Preparation of Composite Magnetic Body]

Example 1

Aqueous solutions of ferrous sulfate and cobalt sulfate were blended so that the mass ratio of Fe and Co in the metal particle was 87.9:12.1, and this was partially neutralized with an alkali aqueous solution (the neutralization step). The aqueous solution after neutralization was bubbled for aeration, and the above described aqueous solution was stirred to obtain the needle-like goethite particle containing Co (the oxidation step). The goethite particle containing Co obtained by filtering the aqueous solution was washed with ion exchange water and dried, and further heated in air to obtain the hematite particle containing Co (the dehydration-annealing step).

The obtained Co-containing hematite particle was heated at a temperature of 550° C. in a furnace having a hydrogen atmosphere (heat treatment step). The atmosphere inside the furnace was switched to argon gas and cooled to about 200° C. While the oxygen partial pressure increased to 21% over 24 hours, it was cooled to room temperature to obtain the metallic particle that had a metal core portion and a metal oxide film and was mainly composed of Fe and Co (the gradual oxidation step). The evaluation results of the obtained metal particles are shown in Table 1.

An acetone solution (solid content concentration: 50 mass %) of a solid epoxy resin (trade name: N-680 manufactured by DIC Corporation) and a curing agent were added to the obtained metal particles so that the volume ratio of the metal particles in the solid content of the composite magnetic material was 30 volume %, and the mixture was kneaded at room temperature using a mixing roll to obtain a slurry-like composite magnetic material (the mixing step). The obtained slurry-like composite magnetic material was then applied to a thickness of 500 μm and dried at 60° C. for 1.5 hours to obtain a dried body (the drying step). A plurality of dry bodies obtained by repeating the same operation were stacked and molded at a temperature of 80° C. using a hot water laminator (manufactured by Nikkiso Co., Ltd.) at a molding pressure of 100 MPa and a molding-holding time of 1 minute (the molding step). The obtained molded body was thermally cured at 180° C. for 3 hours, cut out, and processed to obtain the composite magnetic body in Example 1 (the curing step). Therefore, the shape of the composite magnetic body was a rectangular of 1 mm×1 mm×100 mm. The preparation conditions of the composite magnetic body are summarized in Table 2.

Example 2

A composite magnetic body in Example 2 was obtained in the same manner as in Example 1 except that the volume ratio of the metal particle in the solid content of the composite magnetic material was changed to 60 volume % in the mixing step and the molding pressure was changed to 150 MPa in the molding step. The evaluation results of the metal particles are shown in Table 1 and the preparation conditions of the composite magnetic body are summarized in Table 2.

Example 3

A composite magnetic body in Example 3 was obtained in the same manner as in Example 2 except that the molding-holding time was changed to 0.5 minutes in the molding step. The evaluation results of the metal particles are shown in Table 1 and the preparation conditions of the composite magnetic body are summarized in Table 2.

Example 4

A composite magnetic body in Example 4 was obtained in the same manner as in Example 2 except that the molding pressure was changed to 200 MPa in the molding step. The evaluation results of the metal particle are shown in Table 1 and the preparation conditions of the composite magnetic body are summarized in Table 2.

Example 5

A composite magnetic body in Example 5 was obtained in the same manner as in Example 1 except that the volume ratio of the metal particle in the solid content of the composite magnetic material was changed to 40 volume % in the mixing step. The evaluation results of the metal particles are shown in Table 1 and the preparation conditions of the composite magnetic body are summarized in Table 2.

Example 6

A composite magnetic body in Example 6 was obtained in the same manner as in Example 1 except that the metal (Fe and Co) ion concentration in the aqueous solution and the neutralization ratio by the alkali aqueous solution in the neutralization step were changed so that the average major axis diameter and the average aspect ratio of the metal particle were set as shown in the following Table 2. The evaluation results of the metal particles are shown in Table 1 and the preparation conditions of the composite magnetic body are summarized in Table 2.

Example 7

A composite magnetic body in Example 7 was obtained in the same manner as in Example 6 except that the volume ratio of the metal particle in the solid content of the composite magnetic material was changed to 60 volume % in the mixing step and the molding pressure was changed to 150 MPa in the molding step. The evaluation results of the metal particles are shown in Table 1 and the preparation conditions of the composite magnetic body are summarized in Table 2.

Example 8

A composite magnetic body in Example 8 was obtained in the same manner as in Example 7 except that the molding-holding time was changed to 0.5 minutes in the molding step. The evaluation results of the metal particles are shown in Table 1 and the preparation conditions of the composite magnetic body are summarized in Table 2.

Example 9

A composite magnetic body in Example 9 was obtained in the same manner as in Example 7 except that the molding pressure was changed to 200 MPa in the molding step. The evaluation results of the metal particles are shown in Table 1 and the preparation conditions of the composite magnetic body are summarized in Table 2.

Example 10

A composite magnetic body in Example 10 was obtained in the same manner as in Example 6 except that the volume ratio of the metal particle in the solid content of the composite magnetic material was changed to 40 volume % in the mixing step. The evaluation results of the metal particles are shown in Table 1 and the preparation conditions of the composite magnetic body are summarized in Table 2.

Example 11

A composite magnetic body in Example 11 was obtained in the same manner as in Example 4 except that the metal (Fe and Co) ion concentration in the aqueous solution and the neutralization ratio by the alkali aqueous solution in the neutralization step were changed so that the average major axis diameter and the average aspect ratio of the metal particle were set as shown in the following Table 2. The evaluation results of the metal particles are shown in Table 1 and the preparation conditions of the composite magnetic body are summarized in Table 2.

Example 12

A composite magnetic body in Example 12 was obtained in the same manner as in Example 2 except that an aqueous solution of ferrous sulfate was used instead of an aqueous solution of ferrous sulfate and cobalt sulfate in the neutralization step, the metal (Fe) ion concentration in the aqueous solution and the neutralization ratio by the alkali aqueous solution were changed in the neutralization step so that the average major axis diameter and the average aspect ratio of the metal particle were set as shown in the following Table 2, and the volume ratio of the metal particle in the solid content of the composite magnetic material was changed to 50 volume % in the mixing step. The evaluation results of the metal particles are shown in Table 1 and the preparation conditions of the composite magnetic body are summarized in Table 2.

Comparative Example 1

A composite magnetic body in Comparative Example 1 was obtained in the same manner as in Example 7 except that the volume ratio of the metal particle in the solid content of the composite magnetic material was changed to 25 volume % in the mixing step. The evaluation results of the metal particles are shown in Table 1 and the preparation conditions of the composite magnetic body are summarized in Table 2.

Comparative Example 2

A composite magnetic body in Comparative Example 2 was obtained in the same manner as in Example 2 except that the volume ratio of the metal particle in the solid content of the composite magnetic material was changed to 70 volume % in the mixing step. The evaluation results of the metal particles are shown in Table 1 and the preparation conditions of the composite magnetic body are summarized in Table 2.

Comparative Example 3

A composite magnetic body in Comparative Example 3 was obtained in the same manner as in Example 2 except that the molded body was taken out immediately after pressurization and no holding time was provided in the molding step. The evaluation results of the metal particles are shown in Table 1 and the preparation conditions of the composite magnetic body are summarized in Table 2.

Comparative Example 4

A composite magnetic body in Comparative Example 4 was obtained in the same manner as in Example 2 except that the molding temperature was changed to 180° C. in the molding step and the molding pressure was changed to 35 MPa. The evaluation results of the metal particles are shown in Table 1 and the preparation conditions of the composite magnetic body are summarized in Table 2.

Comparative Examples 5 and 6

Composite magnetic bodies in Comparative Examples 5 and 6 were obtained in the same manner as in Example 2 except that the metal (Fe and Co) ion concentration in the aqueous solution and the neutralization ratio by the alkali aqueous solution in the neutralization step were changed so that the average major axis length and the average aspect ratio of the metal particles were set as shown in the following Table 2 and the volume ratio of the metal particles in the solid content of the composite magnetic material was changed to 50 volume % in the mixing step. The evaluation results of the metal particles are shown in Table 1 and the preparation conditions of the composite magnetic body are summarized in Table 2.

Comparative Example 7

A composite magnetic body in Example 7 was obtained in the same manner as in Example 2 except that the metal (Fe and Co) ion concentration in the aqueous solution and the neutralization ratio by the alkali aqueous solution in the neutralization step were changed so that the average major axis length and the average aspect ratio of the metal particle were set as shown in the following Table 2. The evaluation results of the metal particles are shown in Table 1 and the preparation conditions of the composite magnetic body are summarized in Table 2.

Comparative Example 8

A composite magnetic body in Comparative Example 8 was obtained in the same manner as in Example 7 except that the dried body obtained in the drying step was directly subjected to the curing step without the molding step. The evaluation results of the metal particles are shown in Table 1 and the preparation conditions of the composite magnetic body are summarized in Table 2.

Comparative Example 9

A composite magnetic body in Comparative Example 9 was obtained in the same manner as in Example 2 except that a liquid epoxy resin (trade name: EP-4000S, manufactured by ADEKA Corporation) was used instead of the acetone solution of the solid epoxy resin in the mixing step so that the volume ratio of the epoxy resin in the solid content of the composite magnetic material was the same and the composite magnetic material obtained after the mixing step was directly subjected to the curing step without the drying step and the molding step. The evaluation results of the metal particles are shown in Table 1 and the preparation conditions of the composite magnetic body are summarized in Table 2.

[Evaluation Method]

(Size and Aspect Ratio of Metal Particles)

The metal particles obtained in Examples and Comparative Examples were observed with a transmission electron microscope (TEM) at a magnification of 500000 times, and the dimensions (nm) of the metal particle in the major axis direction and the minor axis direction (major axis diameter and minor axis diameter) were measured and the aspect ratio was determined. Similarly, 200 to 500 metal particles were observed, and the average value of major axis diameter, minor axis diameter, and aspect ratio were calculated. The average value of the aspect ratios and the average value of the major axis diameters are shown in Table 1.

(Saturation Magnetization)

The composite magnetic body obtained in Examples and Comparative Examples was processed to 1 mm×1 mm×3 mm and the saturation magnetization (emu/cm$^3$) of the processed composite magnetic body was measured by using a vibrating sample magnetometer (VSM manufactured by TAMAKAWA Co., Ltd.).

(Void Percent Presence and Circle Equivalent Diameter)

The composite magnetic body obtained in Examples and Comparative Examples was cut and a range of 10 μm×15 μm on the cut surface was observed by using a scanning electron microscope (SEM) (SU 8000 manufactured by Hitachi Technologies, Ltd.) at a magnification of 10000 times or more. Image analysis software was used to binarize the voids and other parts using the contrast difference on the SEM image, and the area ratio of the voids occupied to the entire image was thus calculated. Similarly, the area ratio in the SEM images of total 10 places was calculated, and the average value was taken as the void percent presence (area %).

1000 voids were arbitrarily selected in the binarized image and the equivalent circle diameter (Heywood diameter) of the voids were measured. A median diameter (D50) was calculated from the distribution of the obtained circle equivalent diameter, and this was taken as the average circle equivalent diameter. The evaluation results of the percent presence of the voids and the average circle equivalent diameter are shown in Table 3.

(Complex Permeability and Magnetic Loss)

The real part μ', imaginary part μ", and magnetic loss tan $\delta_\mu$ of the complex permeability of the composite magnetic body obtained in Examples and Comparative Examples were measured by a perturbation method with a network analyzer (HP8753D manufactured by Agilent Technologies, Inc.) and a cavity resonator (manufactured by Kanto Electronic Applied Development Co., Ltd.) at a frequency of 1 GHz and 3 GHz, respectively. The measurement results of μ' and tan $\delta_\mu$ are shown in Table 3.

TABLE 1

| | Metal particles | | |
|---|---|---|---|
| | Main component | Major axis length (nm) | Aspect ratio |
| Example 1 | FeCo | 30 | 1.5 |
| Example 2 | FeCo | 30 | 1.5 |
| Example 3 | FeCo | 30 | 1.5 |
| Example 4 | FeCo | 30 | 1.5 |
| Example 5 | FeCo | 30 | 1.5 |
| Example 6 | FeCo | 120 | 10 |
| Example 7 | FeCo | 120 | 10 |
| Example 8 | FeCo | 120 | 10 |
| Example 9 | FeCo | 120 | 10 |
| Example 10 | FeCo | 120 | 10 |
| Example 11 | FeCo | 500 | 10 |
| Example 12 | Fe | 100 | 1.7 |
| Comparative Example 1 | FeCo | 120 | 10 |
| Comparative Example 2 | FeCo | 30 | 1.5 |
| Comparative Example 3 | FeCo | 30 | 1.5 |
| Comparative Example 4 | FeCo | 30 | 1.5 |
| Comparative Example 5 | FeCo | 160 | 12 |
| Comparative Example 6 | FeCo | 25 | 1.3 |
| Comparative Example 7 | FeCo | 650 | 5.5 |
| Comparative Example 8 | FeCo | 120 | 10 |
| Comparative Example 9 | FeCo | 30 | 1.5 |

TABLE 2

| | Volume ratio of metal particles in solid content (volume %) | Resin | Molding condition Temperature (° C.) | Pressure (MPa) | Holding time (minute) |
|---|---|---|---|---|---|
| Example 1 | 30 | Solid epoxy resin | 80 | 100 | 1.0 |
| Example 2 | 60 | Solid epoxy resin | 80 | 150 | 1.0 |
| Example 3 | 60 | Solid epoxy resin | 80 | 150 | 0.5 |
| Example 4 | 60 | Solid epoxy resin | 80 | 200 | 1.0 |
| Example 5 | 40 | Solid epoxy resin | 80 | 100 | 1.0 |
| Example 6 | 30 | Solid epoxy resin | 80 | 100 | 1.0 |
| Example 7 | 60 | Solid epoxy resin | 80 | 150 | 1.0 |
| Example 8 | 60 | Solid epoxy resin | 80 | 150 | 0.5 |
| Example 9 | 60 | Solid epoxy resin | 80 | 200 | 1.0 |
| Example 10 | 40 | Solid epoxy resin | 80 | 100 | 1.0 |
| Example 11 | 60 | Solid epoxy resin | 80 | 200 | 1.0 |
| Example 12 | 50 | Solid epoxy resin | 80 | 150 | 1.0 |
| Comparative Example 1 | 25 | Solid epoxy resin | 80 | 150 | 1.0 |
| Comparative Example 2 | 70 | Solid epoxy resin | 80 | 150 | 1.0 |
| Comparative Example 3 | 60 | Solid epoxy resin | 80 | 150 | 0 |
| Comparative Example 4 | 60 | Solid epoxy resin | 180 | 35 | 1.0 |
| Comparative Example 5 | 50 | Solid epoxy resin | 80 | 150 | 1.0 |
| Comparative Example 6 | 50 | Solid epoxy resin | 80 | 150 | 1.0 |
| Comparative Example 7 | 60 | Solid epoxy resin | 80 | 150 | 1.0 |
| Comparative Example 8 | 60 | Solid epoxy resin | — | — | — |
| Comparative Example 9 | 60 | Liquid epoxy resin | — | — | — |

TABLE 3

| | Saturation magnetization (emu/cm$^3$) | Voids: Percent presence (area %) | Voids: Equivalent circle diameter (μm) | Magnetic property of composite magnetic body: 1 GHz μ' | 1 GHz $\tan\delta_\mu$ | 3 GHz μ' | 3 GHz $\tan\delta_\mu$ |
|---|---|---|---|---|---|---|---|
| Example 1 | 313 | 7.8 | 0.7 | 1.81 | 0.001 | 1.96 | 0.011 |
| Example 2 | 592 | 1.8 | 0.4 | 2.14 | 0.003 | 2.37 | 0.017 |
| Example 3 | 588 | 2.3 | 1.0 | 2.12 | 0.003 | 2.35 | 0.020 |
| Example 4 | 600 | 0.2 | 0.6 | 2.15 | 0.003 | 2.38 | 0.019 |
| Example 5 | 370 | 10.0 | 0.6 | 1.83 | 0.001 | 2.03 | 0.014 |
| Example 6 | 300 | 8.4 | 0.4 | 1.55 | 0.002 | 1.63 | 0.004 |
| Example 7 | 572 | 1.5 | 0.5 | 1.67 | 0.003 | 1.73 | 0.008 |
| Example 8 | 564 | 1.7 | 1.0 | 1.64 | 0.004 | 1.70 | 0.010 |
| Example 9 | 583 | 0.2 | 0.5 | 1.71 | 0.003 | 1.83 | 0.008 |
| Example 10 | 387 | 10.0 | 0.3 | 1.57 | 0.002 | 1.65 | 0.005 |
| Example 11 | 589 | 0.4 | 0.3 | 1.50 | 0.001 | 1.56 | 0.003 |
| Example 12 | 440 | 3.0 | 0.4 | 1.63 | 0.005 | 1.85 | 0.018 |
| Comparative Example 1 | 270 | 2.4 | 0.4 | 1.45 | 0.002 | 1.53 | 0.003 |
| Comparative Example 2 | 640 | 2.3 | 0.2 | 2.24 | 0.005 | 2.58 | 0.024 |
| Comparative Example 3 | 573 | 5.0 | 3.0 | 2.10 | 0.004 | 2.30 | 0.028 |
| Comparative Example 4 | 605 | 0.0 | — | 2.19 | 0.012 | 2.51 | 0.031 |
| Comparative Example 5 | 313 | 2.1 | 0.3 | 1.39 | 0.001 | 1.44 | 0.002 |
| Comparative Example 6 | 573 | 1.8 | 0.5 | 2.23 | 0.005 | 2.49 | 0.023 |
| Comparative Example 7 | 593 | 0.3 | 0.3 | 1.47 | 0.001 | 1.50 | 0.003 |
| Comparative Example 8 | 280 | 35.0 | 5.0 | 1.47 | 0.001 | 1.55 | 0.003 |
| Comparative Example 9 | 604 | 0.0 | — | 2.19 | 0.012 | 2.48 | 0.028 |

As is apparent from Tables 1 to 3, in Examples 1 to 12, the composite magnetic body contains the metal particles having a specific average major axis diameter and specific average aspect ratio, allowing to provide excellent magnetic permeability μ' and magnetic loss tan $\delta_\mu$. The composite magnetic body in Examples 1 to 12 contains a predetermined amount of the voids having small sizes, allowing to reduce magnetic loss in a wide range of high frequency bands.

REFERENCE SIGNS LIST

2: Void, 4: Metal particle, 6: Resin, 10: Composite magnetic body

What is claimed is:

1. A composite magnetic body comprising:

metal particles containing Fe or Fe and Co as a main component;

a resin; and voids, wherein an average major axis diameter of the metal particles is 30 to 500 nm, an average aspect ratio of the metal particles is 1.5 to 10, in a cross section of the composite magnetic body, a percent presence of the voids is 0.2 to 10 area% and an average equivalent circle diameter of the voids is 1 μm or less, a saturation magnetization of the composite magnetic body is 300 to 600 emu/cm$^3$, and the metal particles and the resin do not exist in the voids.

2. A high frequency electronic component comprising the composite magnetic body according to claim 1.

* * * * *